US005385185A

United States Patent [19]

Calvert

[11] Patent Number: 5,385,185

[45] Date of Patent: Jan. 31, 1995

[54] ROUND UP CONTROL SYSTEM FOR VENEER LATHE

[75] Inventor: Harry Calvert, New Smyrna Beach, Fla.

[73] Assignee: Calvert Manufacturing, Inc., Longwood, Fla.

[21] Appl. No.: 114,766

[22] Filed: Aug. 30, 1993

[51] Int. Cl.[6] ..... B27L 5/02; B27B 1/00

[52] U.S. Cl. ..... 144/212; 73/763; 73/769; 83/102; 83/370; 83/371; 144/211; 144/357

[58] Field of Search ..... 73/763, 767, 769, 779; 83/79, 102, 106, 370, 371; 144/2 R, 209 R, 211, 212, 365, 356, 357

[56] References Cited

U.S. PATENT DOCUMENTS

| | | | |
|---|---|---|---|
| 3,244,206 | 4/1966 | Bossen | 144/209 R |
| 3,280,866 | 10/1966 | Erickson | 144/356 |
| 4,392,519 | 7/1983 | Calvert | 144/356 |
| 4,708,180 | 11/1987 | Browning, Jr. et al. | 144/357 |
| 4,791,970 | 12/1998 | Walser et al. | 144/365 |
| 4,893,663 | 1/1990 | Ely | 144/356 |
| 4,989,651 | 2/1991 | Snellgrove | 144/356 |
| 5,035,164 | 7/1991 | Cremona | 144/356 |

FOREIGN PATENT DOCUMENTS 485000 12/1973 Russian Federation .

*Primary Examiner*—W. Donald Bray
*Attorney, Agent, or Firm*—Maguire, Voorhis & Wells

[57] ABSTRACT

In a veneer lathe having a knife mounted to a knife support frame with a backing plate, a roundup control system for a veneer lathe is disclosed that recognizes or detects the production of usable veneer using the body of the knife as a signal source. During initial production of veneer, the lathe produces a trash or roundup veneer that is directed to a chipper through a trashgate. When there begins production of usable veneer, the trashgate is closed and the usable veneer is directed toward production trays or stackers. A sensor or displacement detection device is mounted in the backing plate of the knife support frame lateral the unsupported portion of the knife. As the knife contacts wood, the unsupported span of the knife flexes causing the magnet to move which the sensor detects. The sensor outputs a voltage signal proportional to movement of the knife in magnitude and direction. This voltage signal is relayed to a central processing unit where it is converted into a digital signal. Once a preselected number of consecutive sensors have been activated for a preselected number of scans the veneer lathe begins to produce usable veneer. At this point the knife and carriage are retracted from the block, the trashgate is closed to discard the trash veneer.

20 Claims, 8 Drawing Sheets

ROUND UP CONTROL SYSTEM FOR VENEER LATHE

FIELD OF THE INVENTION

The present invention relates generally to wood working machines known as veneer lathes which produce veneer by turning or "peeling" a log against a non-rotating knife blade. Such machines are adapted to process many different kinds of wood, varying from soft wood such as pine for structural plywood to hardwoods such as oak or birch for furniture veneer. More specifically this invention relates to the detection of usable veneer produced from a veneer lathe. This invention also provides a source of data for the improved performance of related components such as knife pitch (angle) control.

BACKGROUND OF THE INVENTION

A typical veneer lathe, which represents the environment for the present invention, is a dual spindle machine having a pair of axially spaced headstocks mounted on a common bed. A veneer knife is mounted on a knife support frame which is in turn is mounted on a knife carriage. This knife carriage is driven along parallel guidelines extending transversely of the spindle axis. The veneer lathe also includes one or more backup rolls adapted to preclude deflection of the log or block during the veneer peeling operation.

In the cutting process, lathes are equipped to detect the approximate diameter of an incoming block and retract the knife carriage automatically to clear the wood by several inches. To initiate the cut, the knife carriage is advanced cautiously until the highest protruding wood engages the knife, then locked into an advanced feed rate of approximately double veneer thickness. As a result of the uneven block surface, the veneer initially peeled creates what is known as "trash" or "round-up" veneer that is not suitable for commercial use. This trash veneer initially produced is directed through an opened trashgate and on to a chipper. When a minimum sheet of usable veneer is detected, the knife and knife carriage will abruptly leave the cut. The "trash" veneer is allowed to clear the production line, then the trashgate is closed. At that time the knife is advanced at a single peel thickness rate to peel the block to its core. The lathe will initially produce veneer of various sizes, called "random " veneer, until it begins to produce the full-sheet veneer. The random veneer is directed to a clipper and green chain, and the full sheet veneer is directed to production stackers.

SUMMARY OF THE INVENTION

The general aim of the invention is to provide a means for sensing the lateral deflection of knife of a veneer lathe and generate a signal proportional to such deflection. Another object of the present invention is to provide means to apply this signal generated to efficiently recognize or detect the production of usable veneer. Yet another object is to use the signal generated from the lateral variation of the knife to control the pitch or angle of the knife.

These and other objects of the invention are accomplished by defining at least one unsupported span of the knife on a veneer lathe. As the knife initially contacts wood during production of veneer, the knife flexes at the unsupported areas. A sensing device is mounted lateral the unsupported span of the knife to sense or detect the movement of the knife upon contact with the wood. The sensing device generates a signal indicating the knife's contact with the wood. The signal is then compared to pre-selected parameters to satisfy the pre-selected veneer parameters. Once the minimum veneer sheet parameters have been satisfied, the veneer knife carriage and knife is pulled from the block. The trashgate is closed and the veneer is directed to appropriate trays for further commercial production. This invention provides more efficient production of veneer by providing a lesser portion of roundup being directed into the chipper and a greater portion of the usable or commercial veneer directed to the stackers.

While the invention is susceptible of various modifications and alternative constructions, a certain illustrative embodiment has been shown in the drawings and will be described below in considerable detail. It should be understood, however, that there is no intention to limit the invention to the specific form described, but, on the contrary, the intention is to cover all modifications, alternative constructions and equivalents falling within the scope of the appended claims.

DESCRIPTION OF THE INVENTION

Figure 1:
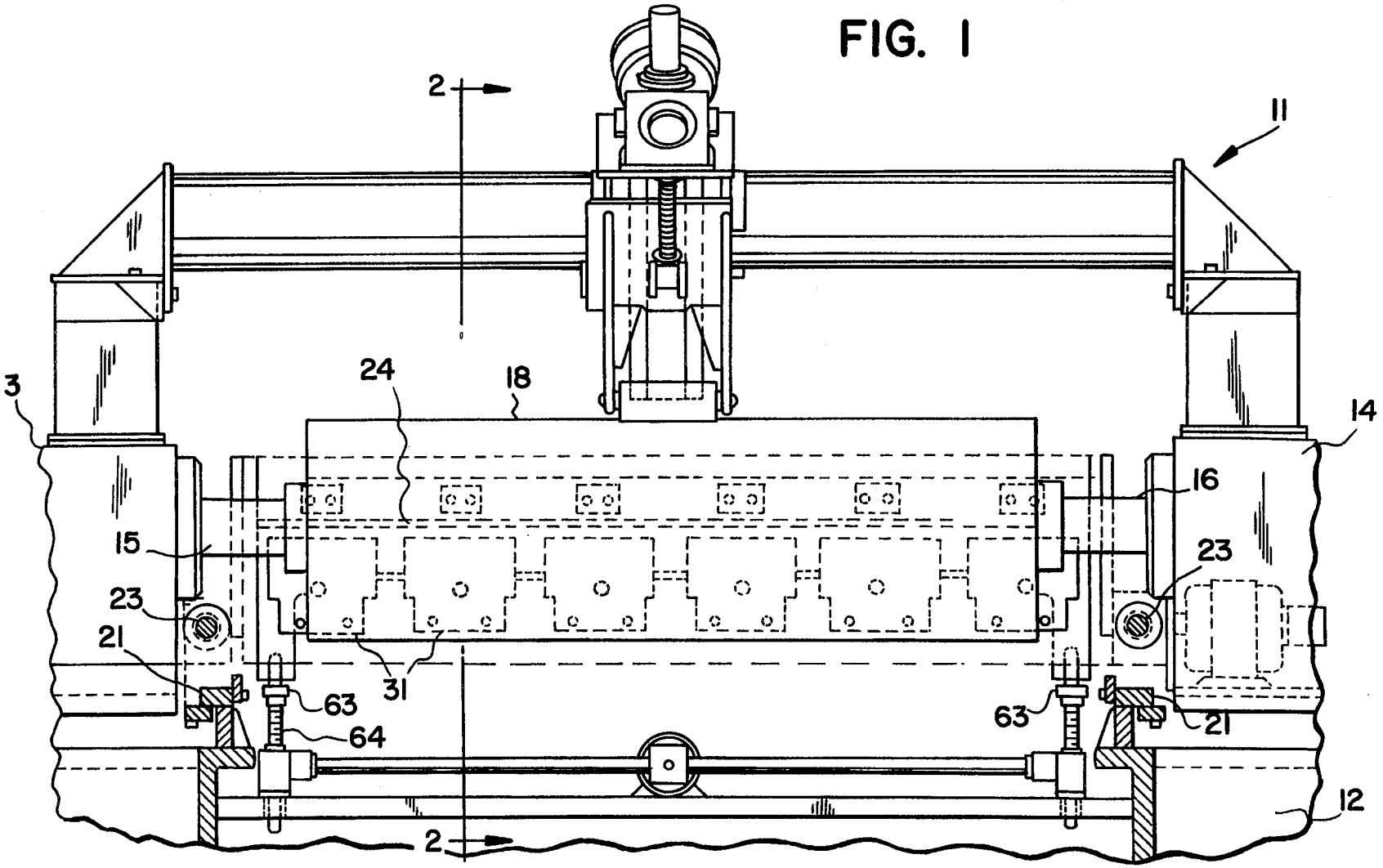
FIG. 1 is a frontal view of a typical veneer lathe.
Figure 2:
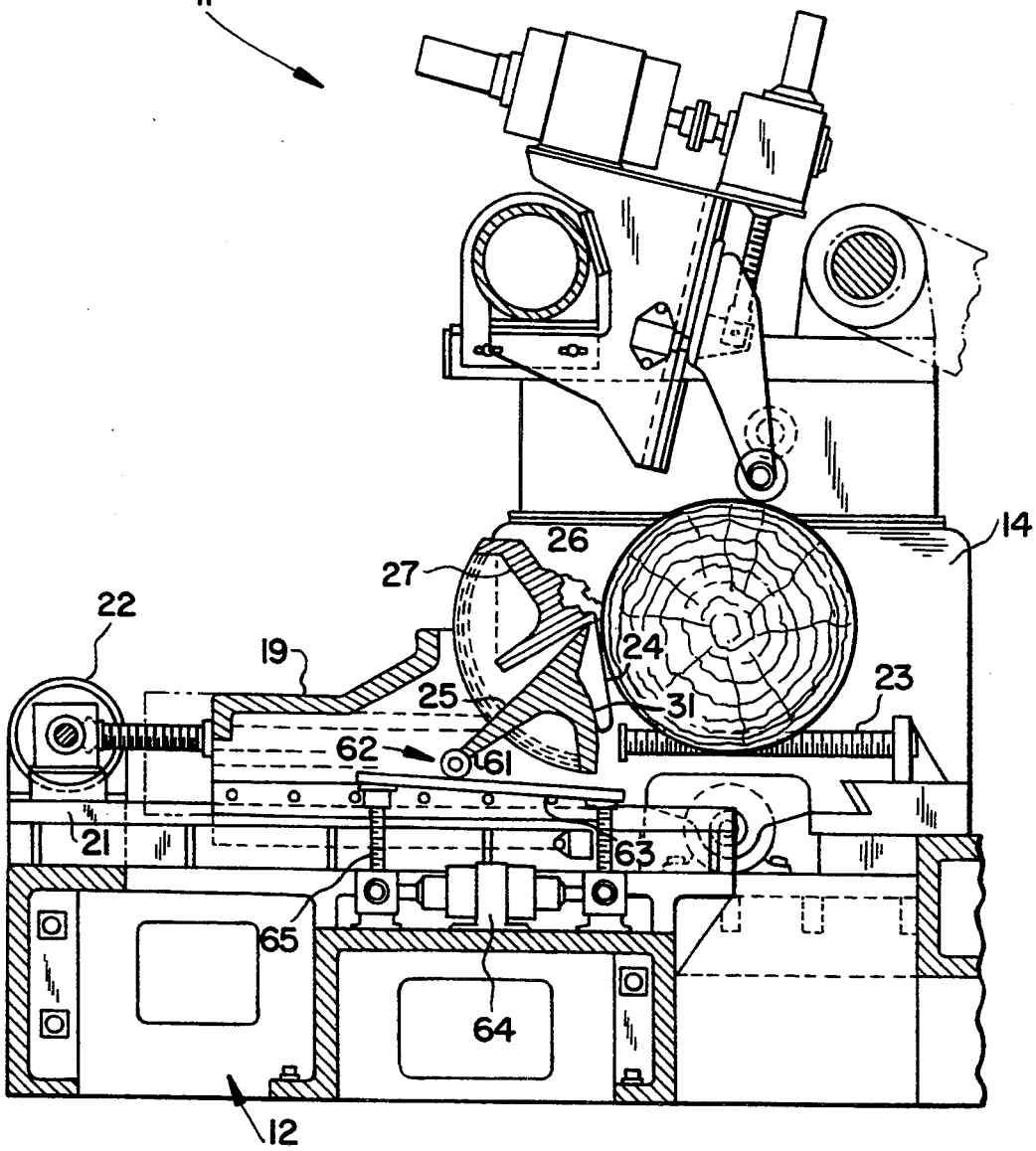
FIG. 2 is a cross sectional view of the veneer lathe taken along the line 2—2 in FIG. 1.
Figure 8:
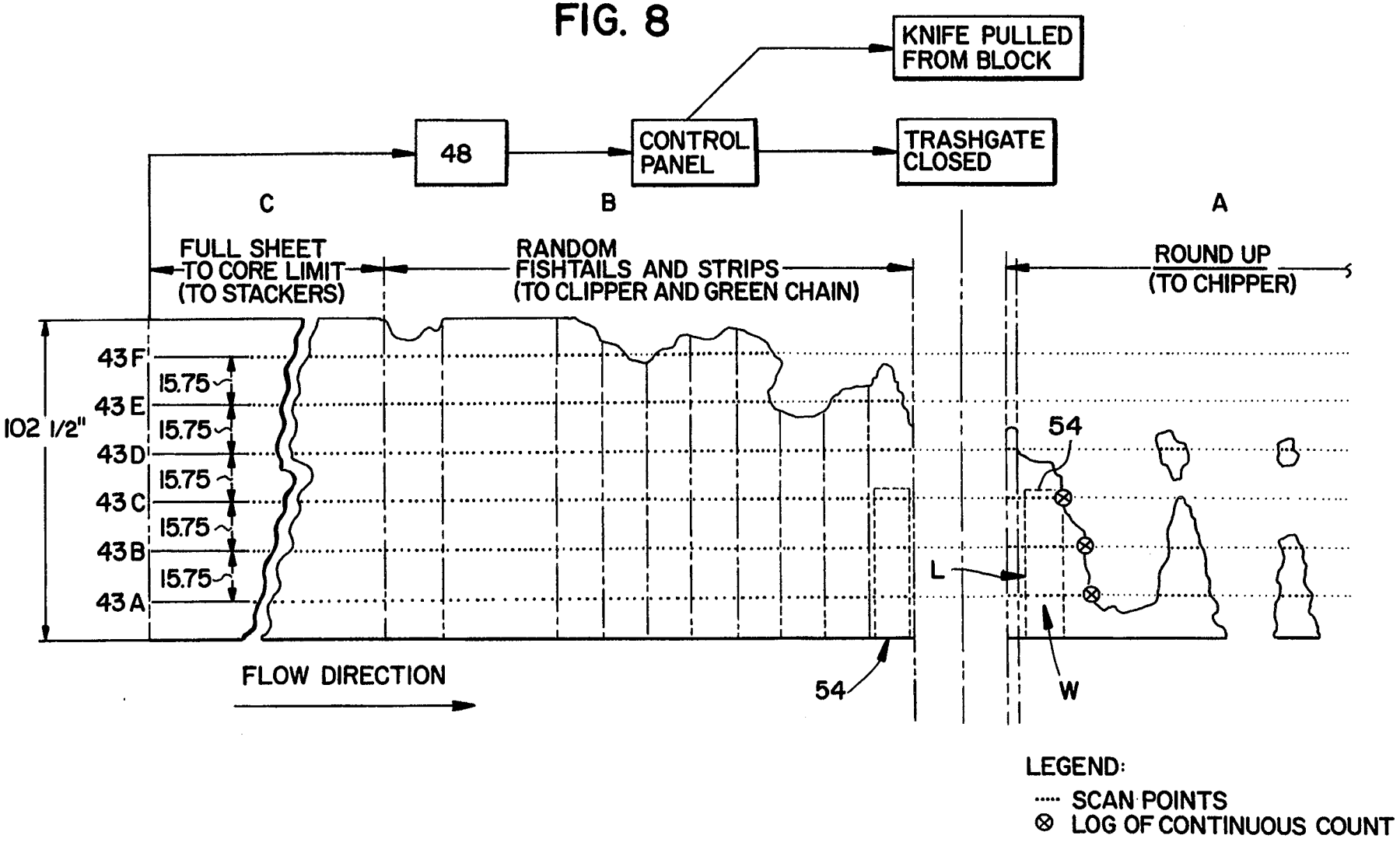
FIG. 8 is a diagram illustrating production of usable veneer.

The environment of the present invention is a veneer lathe 11 of the dual spindle type illustrated in FIGS. 1 and 2, for peeling a wood block 10. Lathes 11 generally comprise a bed 12 which rests on a suitable foundation and supports a pair of axially spaced headstocks 13, 14. A knife carriage 19 is mounted for reciprocating movement on a pair of ways 21 fixed to the machine bed 12 and extending transversely of the spindle axis. The knife carriage 19 is reciprocated along the ways 21 by means of drive motor 22 which is geared to a pair of heavy ball screws 23 which engage suitable threaded sleeves on the carriage. A knife support frame 25 having a backing plate 36 is mounted on the knife carriage 19 in axial alignment with the spindle axis of the spindles 15 and 16. The knife 2 is mounted to the support frame 25 and backing plate 36 by a series of clamps 31 that are bolted to the knife frame 25. The operation of the veneer lathe is generally controlled from a control panel 56 (FIG. 8).

The knife 24 pitch is controlled by the follower arms 61 connected to the respective ends of the support frame 25. Each follower arm 61 has a roller 62 that engages a corresponding pitch rail 63 mounted to the bed 11. The pitch rails may raised and lowered in unison using a pitch rail motor 64 which is geared to their respective jack screws 65.

In accordance with the present invention, the veneer lathe is provided with a round-up control system for quickly recognizing or detecting production of usable veneer by utilizing the body of the knife 24 as a signal source. This is accomplished in the present instance by modifying the backing plate 36 to define at least one unsupported span 33 of the knife blade 24. As shown in FIGS. 3 through 7 this unsupported span 33 is placed in contact with a sensor deflection assembly 34 nested within the backing plate 36. The sensor assembly 34 has a sensor that reacts to minute lateral deflections of the knife body which may be on the order of 0.001 inches to 0.015 inches.

Figure 3:
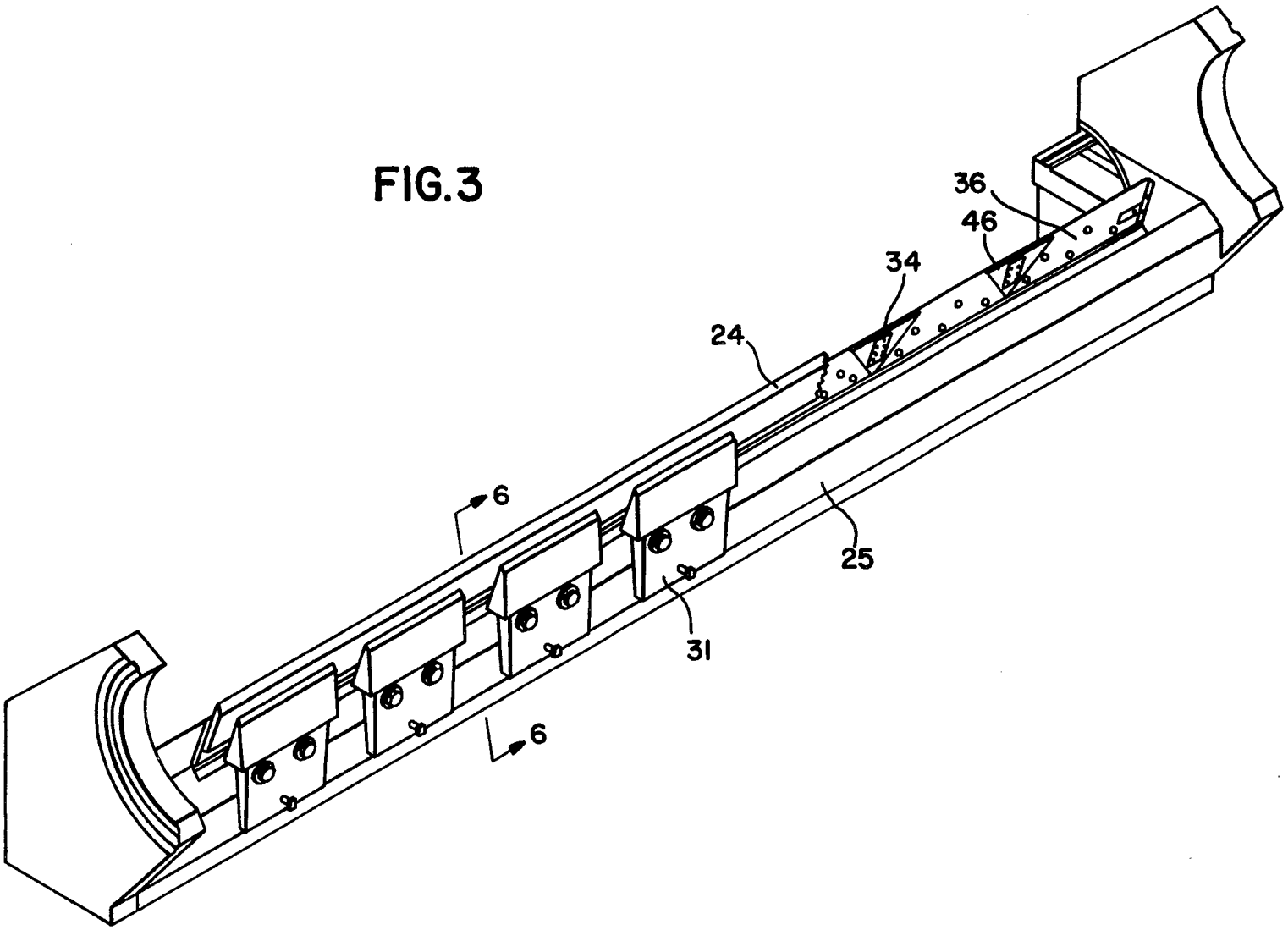
FIG. 3 is a perspective view of a knife clamped to a knife support frame with a backing plate and sensor assemblies mounted therein.
Figure 4:
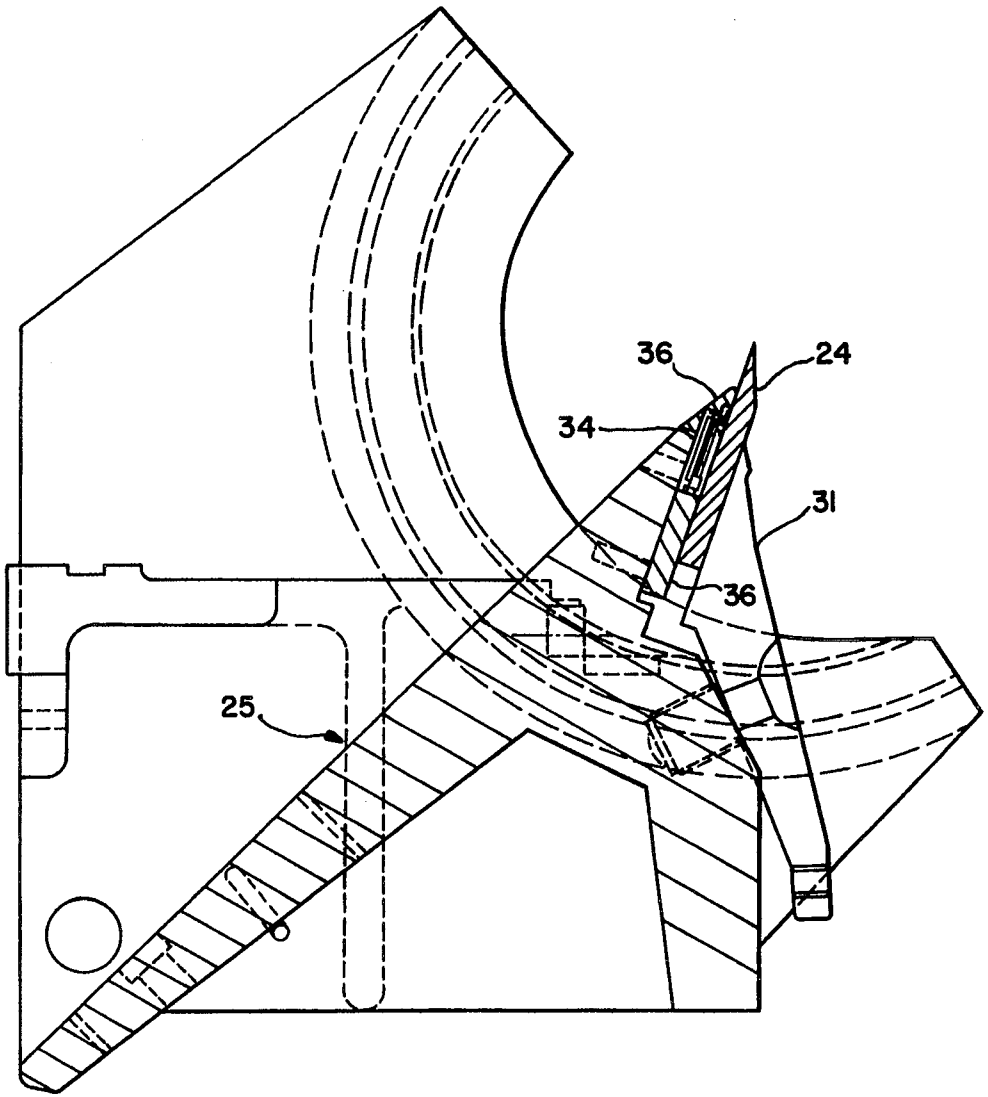
FIG. 4 is a cross sectional view taken along line 4—4 in FIG. 3.
Figure 5:
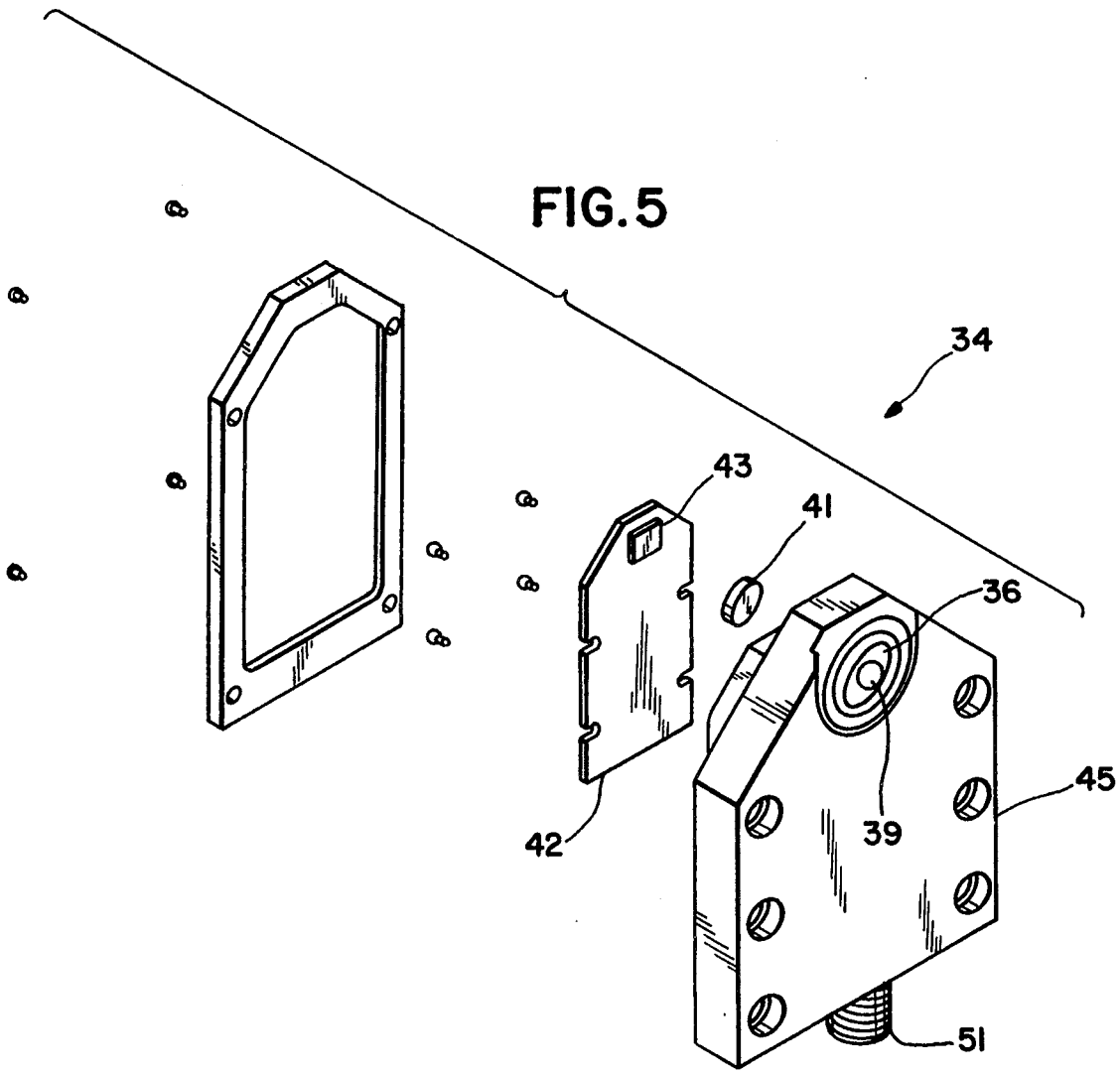
FIG. 5 is a perspective view of a sensor assembly.
Figure 6:
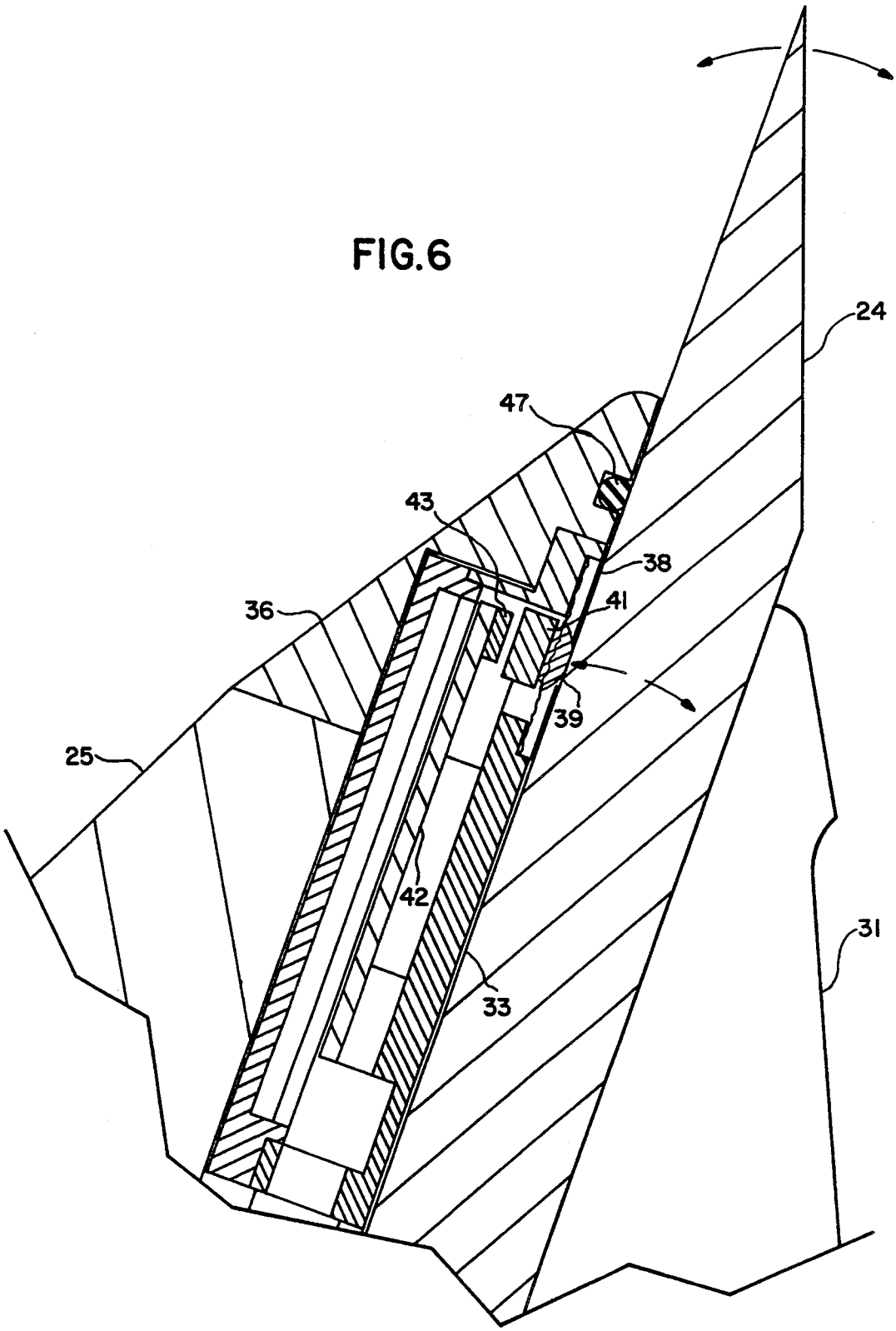
FIG. 6 is a cross sectional view taken along line 6—6 in FIG. 3.
Figure 7:
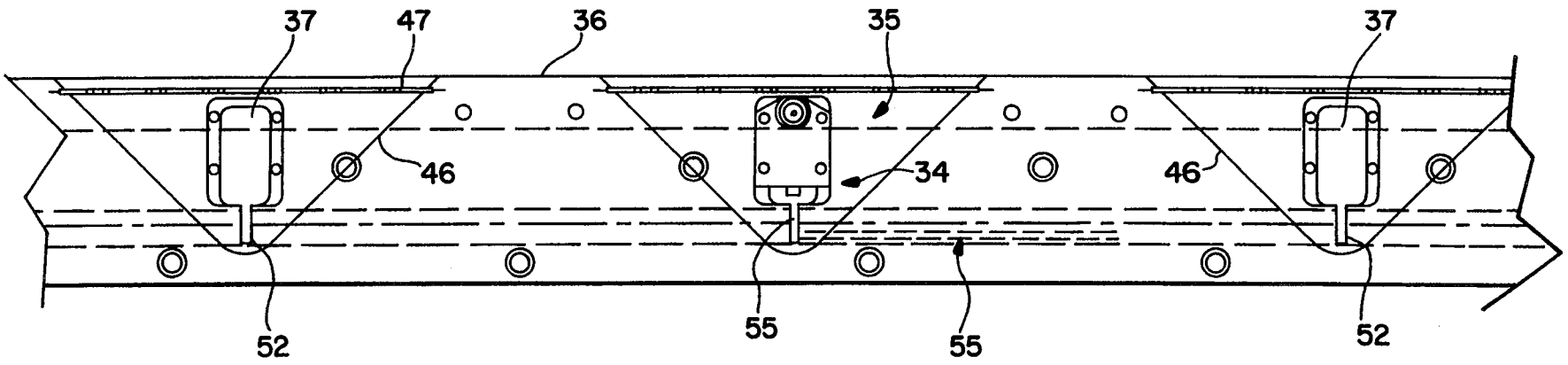
FIG. 7 is a frontal view of a backing plate with a sensor assembly.

Depression 35 machined in the backing plate 36 defines the unsupported span 33 of the knife 24 at each sensor assembly 34, permitting lateral movement of the knife. As represented in FIGS. 3 and 7, the depression 35 includes compartment 37 to accommodate the sensor assemblies 34, and the v-shaded pocket 46 surrounding compartment. The compartment 37 may vary according to the size of the sensor assembly 34, backing plate 36 and/or the position chosen on the backing plate for the assembly, but it must be as least deep enough to permit lateral movement of the knife after the sensor assembly 34 is mounted therein. A rubber seal 47, is mounted in the top of the depression 35 to prevent debris from depositing in the compartment 37 during operation of the lathe 11.

The sensor assembly 34 includes a ¾ inch INCONEL stainless steel diaphragm 38 welded onto a stainless steel body 45. The body 45 may be mounted into the backing plate 36 by socket head cap screws. A carbide puck 39 is attached to the front of the diaphragm 38 where it may contact the knife 24 to minimize wear of the diaphragm 38. A magnet 41 is attached to the backside of the diaphragm 38 using a cynoacrylic cement that is unaffected by high operating temperatures. A suitable magnet is a Dexter model No. 58A621. A circuit board 42 with a sensor 43 aligned with the magnet 41, is mounted to the in the body 45, holding the sensor 43 in space relation to the magnet 41. A suitable sensor 43 is an Allegro Hall Effect transducer, model No. UGN 3503U. The transducer 43 measures magnet flux intensity, and is used to generate a voltage signal proportional to the movement of the magnet 41. The space between the magnet 41 and sensor 43 is preselected and tightly toleranced to assure each sensor assembly 34 will generate a similar signal.

Each sensor assembly 34 is mounted into the compartment 37 so the assembly is recessed below the surface of the backing plate 36, and the puck 39 extends slightly above the surface of the backing plate 36, so the carbide puck 39 contacts the knife 24. When the knife 24 is mounted and tightened in place on the support frame and backing plate 36, the knife contacts the puck, moving the diaphragm and magnet. This movement of the magnet generates a signal that is zeroed to form a baseline for each sensor 43 output. The lateral movement of the knife upon initial contact with the block produces a change in the output signal in both magnitude and direction as explained below.

The embodiment of the invention shown in FIG. 3 utilizes six sensor assemblies 34. A sensor assembly 34 is placed between each clamp 31 allowing easy removal of the sensor assembly 34. The location of the depression 35 and sensor assemblies is dictated by the placement of the knife clamps 31. Each assembly is preferably positioned equidistance apart and centered between the clamps 31 for maximum sensitivity towards movement of the knife 24.

The sensor 43 and circuit board 42 of each sensor assembly 34 is electrically connected to a central processing unit 48. A horizontal groove 53, machined in the backface of the backing plate 36, extends the length of the backing plate to retain cables 54 connecting the sensor 43 to the processing units 48, and a vertical groove 52 is formed in the backing plate 36 at the bottom of each compartment 37 to receive a receptacle 51 on the body 45 and cable 54.

Preselected parameters including the desired minimum length and width of usable veneer are input the central computer processor 48. Additionally, the central processor 48 acquires signals or data in the form of electrical impulses or voltage from the sensor 43 by continually scanning and monitoring for sensor activity. The processing unit 48 is preferably programmed to recognize usable veneer upon activation of a preselected number of consecutive sensors for a preselected number of scans. Once these parameters are satisfied the processor 48 transmits signals to the control unit 56 to initiate the movement of the knife 24 from the block 10 and closing the trashgate 57. Note the software and control system is such that any combination of consecutive sensors activated may satisfy a minimum length. The actual hardware and software including the electrical circuitry utilized to implement the round-up control system are conventional and may be conveniently reproduced by one skilled in art without undue experimentation.

An illustration of veneer production using this invention is depicted in FIG. 8. The direction of the flow of the veneer is illustrated by the arrow. An initial usable veneer sheet meeting minimum preselected parameters is labelled 54. The width of the veneer is labelled W and the length is labelled L. FIG. 7 illustrates veneer peeled by a lathe at a rate of about 1200 feet per minute. The host computer is programmed to scan the sensors 43 (A–F) every 0.75 inches (at 1200 feet per minute) to determine if a sensor 43 has been activated and if an activated sensor 43 has remained active. Each dot represents a scan by the central processor 48 of a sensor assembly 34. The preselected parameters illustrated FIG. 7 include a length (L) requiring at least three consecutive sensors from one end, or four in the middle. To satisfy the width (W) requirement the sensors must remain active for 6 concurrent scans or long enough to peel four inches of veneer.

When a block 10 is initially advanced against a knife 24, the uneven surface of the block 10 causes the lathe to produce trash or round-up veneer, identified in section A, that is discarded through an open trashgate to a chipper. As the knife 24 contacts the block and wood flows over the knife, the knife 24 flexes. The movement of the knife 24 causes the magnet 41, attached to the diaphragm 38, to move. The sensor 43 outputs an electrical signal or analog signal proportional to the magnet 41 movement both in magnitude and direction. The processor unit 48 converts the analog signal to a digital signal.

The host processing unit 48 continually scans the sensor 43 to determine if a sensor is activated. When a sufficient number of counts are accumulated the width (W) requirement is satisfied. In FIG. 7, sensor 43A is activated first and the processor 48 scans sensor 43A six times to determine if it has remained active. Sensors 43B and 43C are respectively activated as further shown in FIG. 7. Each sensor must be activated for a sufficient amount of time in order to satisfy the width requirement as the previously activated sensor. If any sensor is deactivated, then the run time must start over after it is subsequently activated.

As shown in FIG. 8, at that point where it is determined three consecutive sensors (43A–C) have each been concurrently active for six scans (long enough for a four inch wide veneer to be peeled), the round-up is complete and the knife 24 will be pulled from the block 10. The trashgate then closes so that veneer produced subsequently will be diverted to trays for further production. The knife 24 is again advanced against the knife so the knife 24 reenters the cut. The block is peeled to a minimum diameter while the usable veneer is directed to production trays. The lathe first produces the random veneer in section B which is directed to the clipper and green chain. The full sheet veneer in section C is directed to the production trays or stackers.

Additionally, during the actual peeling of the usable veneer the varying density of the wood block 10 and the setting of the knife angle change may cause knife to move laterally from a position of equilibrium. As the usable veneer is peeled the central processing unit 48 continually scans the sensors 43 to obtain an average or median signal output defining the baseline during peeling of usable veneer. The direction of lateral variation or movement of the knife beyond this baseline is detected as a change in the voltage output of the sensor 43. For example, the processing unit 48 may be programmed to detect the change in the output of sensor 43 when the knife 24 moves away from the support frame 25 and backing plate 36 and toward the core of the block 10, as a more positive voltage output. Moreover, the magnitude of the change in voltage is determined by the processing unit 48 by comparing the voltage output to the median signal. This data supporting the direction and magnitude of the lateral movement of the knife 24 is applied to determine in which direction and what angle the knife 24 must be adjusted to its equilibrium position. The physical adjustment of the knife is performed using conventional devices 61, 62 and 63 associated with the veneer lathe which with usually result in the adjustment of backside of the support frame 25 to move the knife 24 angle. The circuitry and software is conventional and known to those skilled in the art.

While this specification discloses the best mode contemplated for carrying out the present invention, it will be apparent that modification variations may be made without departing from what is regarded to be the subject matter of the invention as set forth in the appended claim.

What I claim is:

1. A round-up control system for a veneer lathe having a knife support frame and a knife mounted thereon, for peeling a veneer, initially producing trash veneer, comprising:

(a) sensor means for generating a signal proportional to the lateral displacement of the knife; and (a) means, responsive to said signal generated, for applying said signal to recognize the production of usable veneer satisfying preselected parameters.

2. A round-up control system as defined in claim 1 wherein said sensor means includes:

(a) means, formed in the knife support frame, defining at least one unsupported portion of the knife; and (b) a displacement detection device, mounted in the support frame, lateral the unsupported portion of the knife, for generating a signal proportional to said lateral displacement of the knife.

3. A round-up control system as defined in claim 2 further including a trashgate for disposing of trash veneer initially produced from the lathe and means for closing the trashgate upon recognition of usable veneer.

4. A round-up control system as defined in claim 3 wherein said displacement detection device includes a transducer, in electrical communication with said signal application means, held in spaced relation to a magnet in contact with the unsupported portion of said knife.

5. A round-up control system as defined in claim 1 further including a trashgate for disposing of trash veneer initially produced from the lathe and means for closing a trashgate when usable veneer has been recognized.

6. A round-up control system as defined in claim 1 wherein said sensor means includes a displacement detection device mounted in the knife support disposed in a engagement with an unsupported portion of the knife, with said detection device adapted to generate a signal proportional to the movement of the knife.

7. A round-up control system for a veneer lathe having a knife support frame with a knife mounted thereon for peeling a veneer, said lathe initially producing trash veneer, comprising:

(a) means defining at least one laterally unsupported portion of said knife, intermediate the ends thereof;

(b) sensor means disposed lateral the unsupported portion of the knife for sensing lateral displacement thereof;

(c) means, connected to said sensor means, for generating a signal proportional to the lateral displacement of the knife; and (d) means for applying the signal generated from said sensor means to detect production of a usable veneer according to preselected parameters.

8. A round-up control system as defined in claim 9 wherein said sensor means includes a displacement detection device mounted in the support frame lateral the unsupported portion of the knife to sense lateral movement of the knife.

9. A round-up control system as defined in claim 8 wherein said displacement detection device includes a transducer, in electrical communication with said signal application means, held in spaced relation to a magnet in contact with said unsupported portion of the knife.

10. A round-up control system as defined in claim 9 wherein said unsupported portion is defined by at least one depression area formed in the support frame lateral the knife with said displacement detection device mounted in the support frame adjacent the pocket.

11. A round-up control system as defined in claim 10 further including a trashgate to dispose of trash veneer initially produced from the lathe and means for closing the trashgate upon recognition of usable veneer.

12. A round-up control system as defined in claim 7 further including a trashgate to dispose of trash veneer initially produced from the lathe, and means for closing the trashgate upon recognition of usable veneer.

13. A veneer lathe, comprising:

(a) a knife mounted to a knife support frame on the veneer lathe to peel veneer from a block, said lathe initially producing trash veneer;

(b) means, formed in said knife support frame, defining a laterally unsupported portion of the knife;

(c) a displacement detection device mounted into the knife support frame lateral the unsupported portion of the knife to detect lateral movement of said knife, said detection device being adapted to generate a signal proportional to the lateral movement of the knife; and (d) means for applying said signal to recognize when the veneer lathe begins to produce a usable veneer in satisfaction of preselected parameters.

14. A veneer lathe as defined in claim 13 wherein said displacement device includes a transducer, in electrical communication with said signal application means, and held in spaced relation with a magnet in contact with the unsupported portion of the knife.

15. A veneer as defined in claim 14 further including a trashgate held open to dispose of the trash veneer initially produced from the lathe and means for closing the trashgate upon recognition of usable veneer.

16. A veneer lathe as defined in claim 15 wherein said signal application means includes means for converting an analog signal generated by said displacement detection device to a digital form.

17. A veneer lathe, comprising:

(a) a knife mounted to a knife support frame on the veneer lathe for peeling a veneer from a block, said lathe initially producing trash veneer;

(b) a plurality of depression areas formed in the knife support frame defining corresponding unsupported portions of the knife;

(c) a sensor means, adjacent each pocket, for generating a signal proportional to the lateral movement of the knife; and (d) means for applying the signal generated to recognize production of usable veneer satisfying a set of preselected parameters.

18. A veneer lathe as defined in claim 17 further including a trashgate for disposal of trash veneer initially produced by the lathe and means for activating the trashgate to close upon recognition of usable veneer.

19. A veneer lathe as defined in claim 18 wherein said displacement device includes a transducer held in spaced relation to a magnet in contact with the unsupported span of the knife.

20. A veneer lathe as defined in claim 19 wherein said application means includes means for converting the analog signal generated by said detection device to the digital form.

* * * * *